US005755066A

United States Patent [19]

Becker

[11] Patent Number: 5,755,066

[45] Date of Patent: May 26, 1998

[54] SLIP TRACK ASSEMBLY

[76] Inventor: Duane William Becker, 34747 CSAH 17, Watkins, Minn. 55389

[21] Appl. No.: 566,827

[22] Filed: Dec. 4, 1995

Related U.S. Application Data

[63] Continuation-in-part of Ser. No. 160,406, Dec. 2, 1993, Pat. No. 5,471,805.

[51] Int. Cl.[6] ..... E04H 1/00

[52] U.S. Cl. ..... 52/241; 52/481.1; 52/290; 52/243.1; 52/586

[58] Field of Search ..... 52/241, 242, 243.1, 52/481.1, 481.2, 733.2, 733.4, 588.1, 573.1, 239

[56] References Cited

U.S. PATENT DOCUMENTS

| | | | |
|---|---|---|---|
| 2,313,839 | 3/1943 | Olsen | 52/242 |
| 2,958,982 | 11/1960 | Baker | 52/241 |
| 3,397,495 | 8/1968 | Thompson | 52/241 |
| 3,447,275 | 6/1969 | Vanghan et al. | 52/241 X |
| 3,481,090 | 12/1969 | Lizee | 52/241 |
| 3,744,199 | 7/1973 | Navarre | 52/241 |
| 3,759,001 | 9/1973 | Judkins et al. | 52/481.1 |
| 3,861,103 | 1/1975 | Rasmussen | 52/241 |
| 3,900,996 | 8/1975 | Yohe | 52/241 |
| 4,229,918 | 10/1980 | Delcroix | 52/242 |
| 4,283,892 | 8/1981 | Brown | 52/241 |
| 4,833,849 | 5/1989 | Williams et al. | 52/481.1 |
| 5,127,760 | 7/1992 | Brady | 403/230 |
| 5,203,132 | 4/1993 | Smolik | 52/242 |

FOREIGN PATENT DOCUMENTS

| | | | |
|---|---|---|---|
| 0597076 | 4/1960 | Canada | 52/481.1 |
| 1374956 | 9/1964 | France | 52/242 |
| 1232452 | 4/1971 | United Kingdom | 52/241 |

OTHER PUBLICATIONS

Memorandum from the Office of Statewide Health Planning and Development, Apr. 20, 1993, re Deflection Track Detail.

Catalog of Unimast Incorporated, Steel Framing Components and Accessories for Drywall, Plaster and Load-Bearing Construction, 1992, See p. 14.

Catalog of United States Gypsum Company, Systems Folder SA-923—1993 Edition, Drywall/Steel Framed Systems, 1993, See pp. 9, 23,25, 30.

Technical Book of Unimast Incorporated, Steel Framing Systems Technical Information, 1991. See pp. 4, 28.

Brochure from Metal-Life, Inc. re "SLP-TRK" Slotted Track.

"New Solution for an Old Problem", Walls & Ceilings, Aug. 1994, pp. 40–41.

1991 Unimast Corp. Catalog.

UL Report of "Perimeter Relief Runner System Details of Use in Nonbearing Walls", Jun. 23, 1966, pp. 1–C4.

Engineering Study on Perimeter Relief System for Use in Nonbearing Partition Systems, Factory Mutual Research Corporation, Jun. 18, 1969, pp. 1–20.

*Primary Examiner*—Carl D. Friedman
*Assistant Examiner*—Winnie S. Yip
*Attorney, Agent, or Firm*—Merchant, Gould, Smith, Edell, Welter & Schmidt, P.A.

[57] ABSTRACT

A slip track assembly having a slip track mechanism and a non-combustible secondary member which together are fastened to a structural element and slidingly receive the studs and primary wall member of a non-load bearing stud wall so as to provide a desired fire barrier connection.

4 Claims, 9 Drawing Sheets

SLIP TRACK ASSEMBLY

This is a Continuation-In-Part of application Ser. No. 08/160,406 which was filed on Dec. 2, 1993, U.S. Pat. No. 5,471,805.

FIELD OF THE INVENTION

The present invention is directed generally to the field of construction and, more particularly, to fire barrier connections.

BACKGROUND OF THE INVENTION

There appears to be an increasing awareness among architects and specification writers of the need to protect the public through the use of fire-rated partitions. Code officials also are more aggressively enforcing fire codes and paying closer attention to the many details that are necessary in firewall construction. They are taking these actions to ensure that fire-rated partitions perform as intended. Building codes typically require fireproof ratings of one hour, two hours, or some other time period for walls and connections between walls and the roof or other overhead structure.

A typical wall to roof connection is an inverted U-shaped longitudinal slip track which receives studs between the legs of the U-shaped track. A wall board is attached to at least one side of the studs. One of the legs of the slip track is received between the studs and the wall board. The studs and wall board are spaced from the overhead structure or roof in order to allow for settling or other movement of the overhead structure or roof with respect to the wall. A caulking is installed next to the slip track in the space between the wall board and the overhead structure. The caulking and wall board have the appropriate fire rating.

Problems with this typical connection is that not only is the caulking expensive, but it has a tendency to harden and crack during settling of the overhead structure. The caulking can then crumble away and leave voids. The same problems associated with building movement occur in vertically and horizontally aligned fire rated wallboard connections. For example, building movement negatively effects vertical seams between consecutive sheets of wallboard in a stud wall. Building movement is also a factor in substantially vertical connections made between stud walls and such conventional structural elements as interior walls, exterior walls and floor assemblies.

SUMMARY OF THE INVENTION

The present invention is directed to a slip track assembly for connecting a stud assembly and a structural element. The slip track assembly includes a slip track with parallel first and second surfaces offset from one another on a common side of the studs of the stud assembly. The track also includes a third surface on the opposite side of the studs. The track has an orthogonal surface extending between two of the surfaces so that the orthogonal surface can be fastened to the structural element. The slip track assembly further includes a non-combustible secondary member and mechanism for attaching the secondary member to the second surface of the slip track. The secondary member has an edge adjacent to the structural element and is slidable with respect to a primary member attached to the studs.

The slip track assembly eliminates the need for caulking and rather, as a result of the shape of the slip track, provides for use of a secondary member to complete a fire barrier between the primary member and the structural element such as a roof, wall or floor assembly.

The method of using the slip track assembly for providing a fire barrier connection between a stud assembly and an structural element includes attaching the slip track to the structural element, installing the studs in a sliding relationship between first and third surfaces of the slip track and attaching the primary member to the studs so as to have a sliding relationship with the first surface of the slip track, and attaching the secondary member to the second surface of the slip track so as to be adjacent to the structural element and to have a sliding relationship with the primary member.

The present invention also relates to a fire-resistant connection joint for use with a stud assembly. The joint includes a slip track including first and second substantially parallel surfaces that are offset from each other. The joint also includes a fire-resistant secondary member affixed to the second surface and a fire-resistant primary member adapted to have a sliding relationship with the secondary member. The primary and secondary members are arranged and configured to overlap one another such that a fire-resistant barrier is maintained when the primary and secondary members slide relative to each other.

The present invention is thus simple, economical, environmentally friendly, and easy to install since it uses the same materials as those required to construct the stud wall.

DETAILED DESCRIPTION OF THE PREFERRED EMBODIMENT

Figure 1:
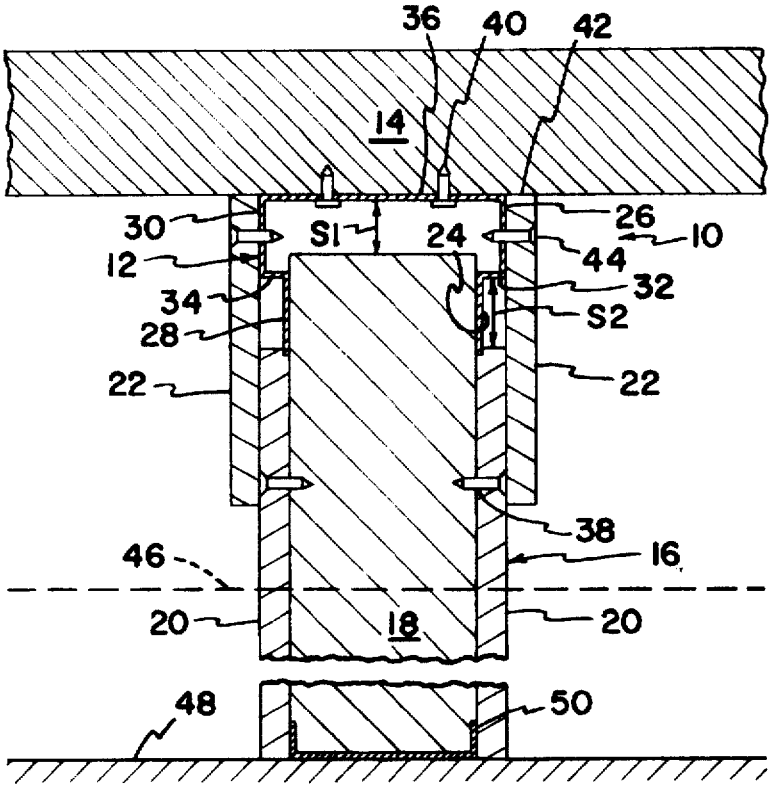
FIG. 1 is a cross-sectional view showing in profile a slip track assembly in accordance with the present invention.

Referring now to the drawings wherein like reference numerals designate identical or corresponding parts throughout the several views, and more particularly to FIG. 1, a preferred slip track assembly in accordance with the present invention is designated generally by the numeral 10. Slip track assembly 10 includes a slip track 12 fastened to an overhead structure 14, such as a roof. A non-load bearing stud wall 16 is formed from a plurality of studs, such as the stud 18 shown, and a primary wall member 20 attached thereto. A secondary wall member 22 is attached to slip track 12 and extends between overhead structure 14 and primary wall member 20.

Slip track 12 is shown in FIG. 1 as a unitary member. Slip track 12 has any convenient length. It is preferably metallic. Slip track 12 has parallel first and second surfaces 24 and 26 offset from one another on a common side of studs 18. Slip track 12 includes third and fourth surfaces 28 and 30 on an opposite side of stud 18. Stud 18 is received between the portions of slip track 12 identified as first and third surfaces 24 and 28. Horizontal surfaces 32 and 34 extend between first and second surfaces 24 and 26 and between third and fourth surfaces 28 and 30, respectively. A horizontal surface 36 extends between surfaces 26 and 30.

Primary wall member 20 is fastened to stud 18 in a conventional fashion, as with screws 38. Stud 18 is commonly a metallic post, but could be wood or other material conventionally used as a stud. Primary wall member 20 is commonly gypsum board, but could be other wall material having a required fire rating for the particular application. In that regard, it is understood that primary wall member 20 could also be multiple layers of wall material to create the required fire rating. Stud 18 is spaced from roof structure 14 a distance S1. Distance S1 is commonly about one inch, but could be more. Likewise, primary wall member 20 is spaced a distance S2 from horizontal surface 32. Distance S2 is also generally approximately one inch, but could be more. The primary wall member on the opposite side of stud 18 as member 20 is installed similarly. First and third surfaces 24 and 28 have a sliding relationship between the primary wall members and stud 18.

Slip track 12 is attached to roof structure 14 with screws 40 or other common attachment mechanisms.

Secondary wall member 22 extends from having an edge 42 adjacent to overhead structure 14 down to and overlapping in a slidable relationship with primary wall member 20. Secondary wall member 22 is attached to second surface 26 with screws 44 or other conventional fastening mechanism. Similarly, a secondary wall member on the side of stud 18 opposite secondary wall member 22 is shown attached to slip track 12. The secondary wall members are made of material similar to the primary wall members and have a similar thickness so as to provide a similar fire rating.

Slip track assembly 12 is necessarily adjacent to and attached to an overhead structure, such as a roof. In that regard, the ceiling of a room may be spaced beneath assembly 10 as shown by line 46. A floor 48 is also shown.

In use, the embodiment of FIG. 1 involves attaching slip track 12 to overhead structure 14 with screws 40. Studs 18 are retained and otherwise fastened in a conventional way between a track 50 attached to floor 48 and first and third surfaces 24 and 28 of slip track 12. The primary wall members 20 are attached to studs 18 so that primary wall members 20 can slide between secondary wall members 22 and first or third surfaces 24 or 28, while stud 18 is allowed to also slide relative to first and third surfaces 24 and 28. Finally, secondary wall members 22 are fastened to second and fourth surfaces 26 and 30. Secondary wall members 22 cover the space between the top end of primary wall members 20 and the overhead structure 14 and do so in a way which allows movement between slip track structure attached to overhead structure 14 and the stud wall structure. Thus, the overhead structure 14, slip track 12, and secondary wall members 22 can move relative to studs 18 and primary wall members 20 the distances S1 or S2, the two distances being very similar in length.

Figure 2:
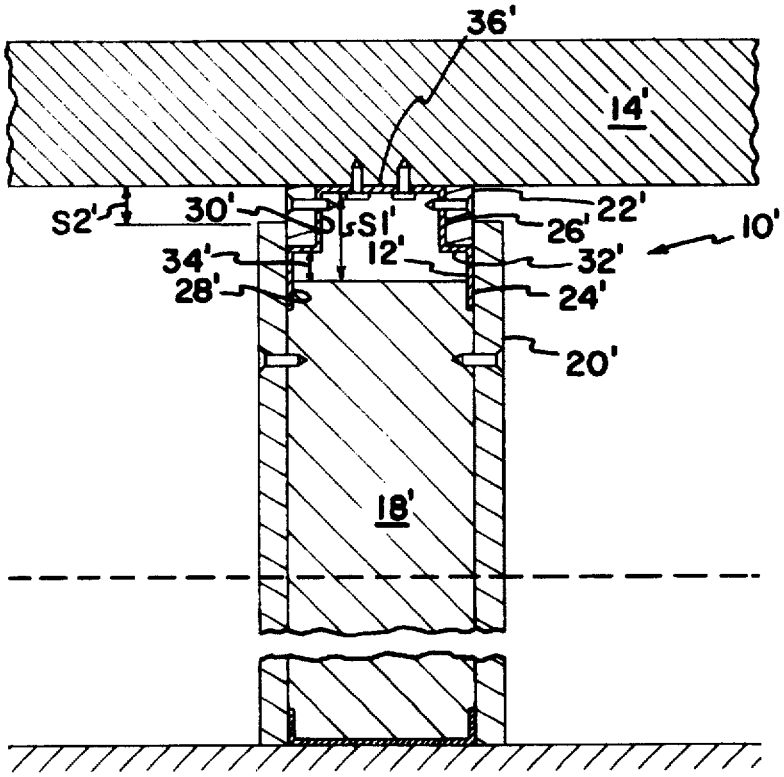
FIG. 2 is a cross-sectional view showing an alternate embodiment.

A second embodiment is shown in FIG. 2 wherein like structure to that of FIG. 1 is identified by like numerals, only primed. In that regard, slip track 12' has a different shape which results in secondary wall members 22' being on the inside of primary wall members 20'. Otherwise, the construction of the second embodiment is the same as the first embodiment.

Slip track 12' has first and third surfaces 24' and 28' spaced apart further from one another than second and fourth surfaces 26' and 30'. Horizontal surfaces 32' and 34' extend between first and second surfaces 24' and 26' and between third and fourth surfaces 28' and 30'. Horizontal surface 36' extends between second and fourth surfaces 26' and 30' and is attached to the overhead structure 14'. Secondary wall members 22' fill the space between horizontal surfaces 32', 34' and overhead structure 14'. Stud 18' is spaced a distance S1' from horizontal surfaces 32' and 34', while primary wall members 20' are spaced a distance S2' from overhead structure 14'. In this way, slip track 12' and primary and secondary wall members 20' and 22' function to provide a fire barrier between the stud wall and the overhead structure. At the same time, space is provided for settling and expansion.

Figure 3:
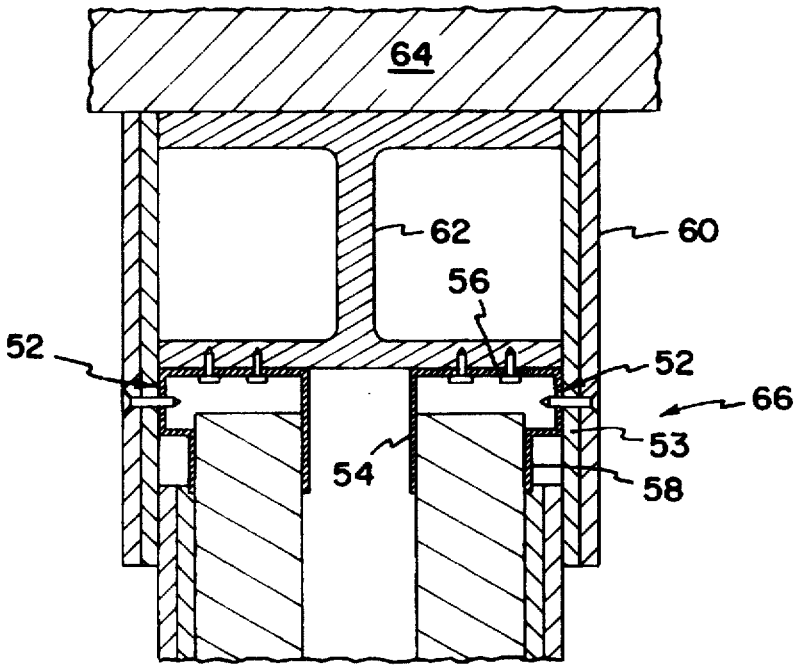
FIGS. 3–7 are further alternatives shown generally in cross-section and illustrating variations on the general shapes of the embodiments of FIGS. 1 and 2.

The embodiments shown in FIGS. 3–7 illustrate further variations possible. In FIG. 3, a pair of slip tracks 52 are shown with each having a single vertical surface 54 extending to horizontal surface 56 which is attached to the overhead structure. The stud is received between the first surface 58 and surface 54. Secondary wall members 60 are shown in double layer, are attached to second surface 53, and extend beyond slip track 52 and a beam 62 to roof 64. Slip track assembly 66 functions, however, similar to slip track assemblies 10 and 10'. A mirror image of slip track assembly 66 and the construction associated with it is shown on the left of FIG. 3. Such mirror image construction need not, however, be necessary depending on the construction of a particular facility.

Figure 4:
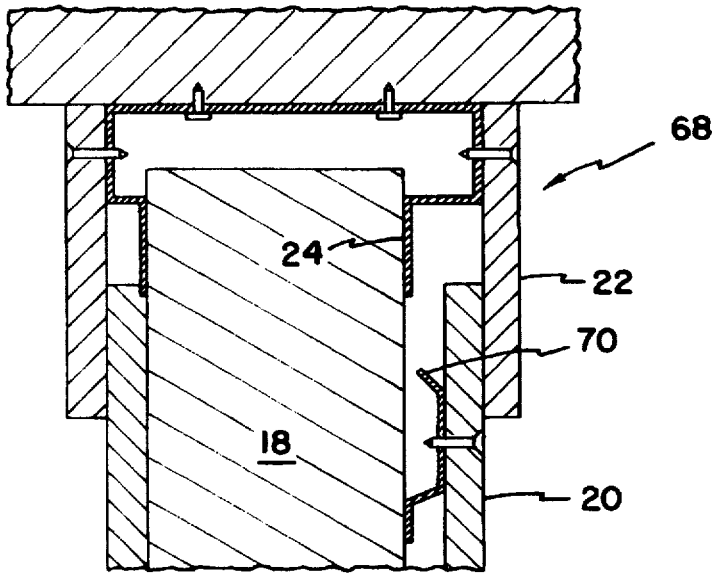

Slip track assembly 68 in FIG. 4 is the same as slip track assembly 10 except that one of primary wall members 20 is spaced from stud 18 by a spacer 70. Although primary wall member 20 and secondary wall member 22 are in an overlapping, sliding relationship with one another, primary wall member 20 is not in contact with first surface 24.

Figure 5:
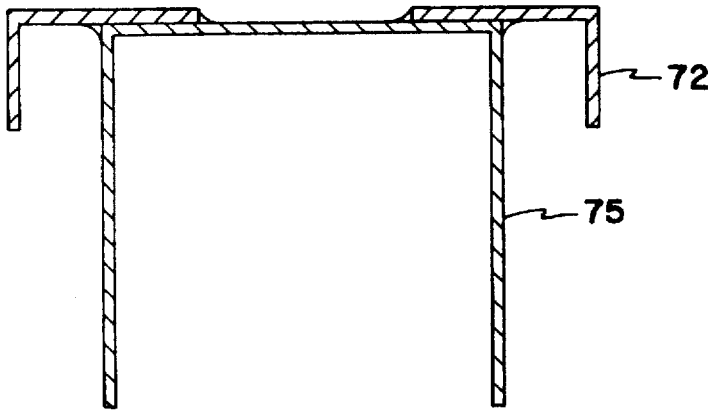
Figure 6:
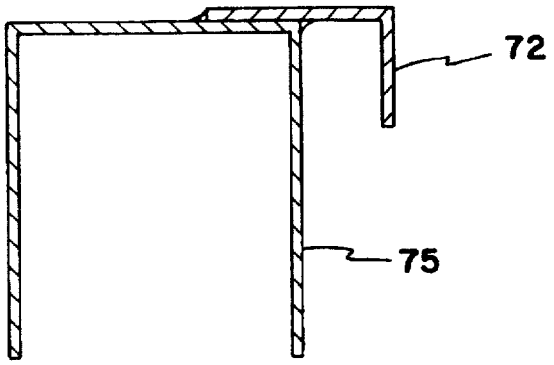
Figure 7:
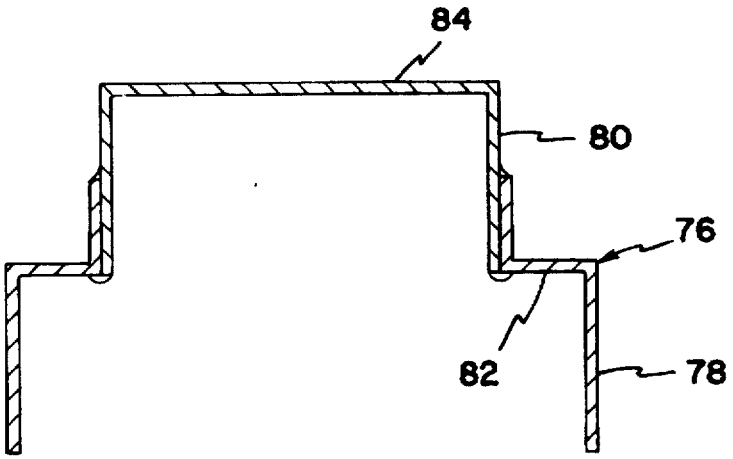

The embodiments of slip tracks shown in FIGS. 5–7 illustrate that the slip tracks are not necessarily unitary. With respect to FIG. 5, the third surfaces 72 are formed by one leg of an L-shaped piece screwed, pop riveted, welded, or otherwise fastened to an inverted U-shaped member 74. A similar result is achieved on one side as shown in FIG. 6. With respect to FIG. 7, the reverse profile of FIG. 2 is obtained using a member 76 having offset parallel surfaces 78,80 running in opposite directions from a horizontal surface 82. One of the parallel surfaces, for example, surface 80 is fastened to an inverted U-shaped member 84.

It is further noted that the slip tracks of the present invention can also be used vertically or in other orientations at dissimilar constructions to provide a fire barrier and provide for expansion. For example, a slip track assembly in accordance with the principles of the present invention can be used to provide a slidable, fire-resistant vertical or horizontal seam between consecutive sheets of fire rated wallboard. The slip track assembly can also be used to provide slidable connections between stud walls and such conventional structural elements as interior walls, exterior walls and floor assemblies. It will be appreciated that the above mentioned uses are merely illustrative and are not to be construed as limitations upon the invention.

Figure 8:
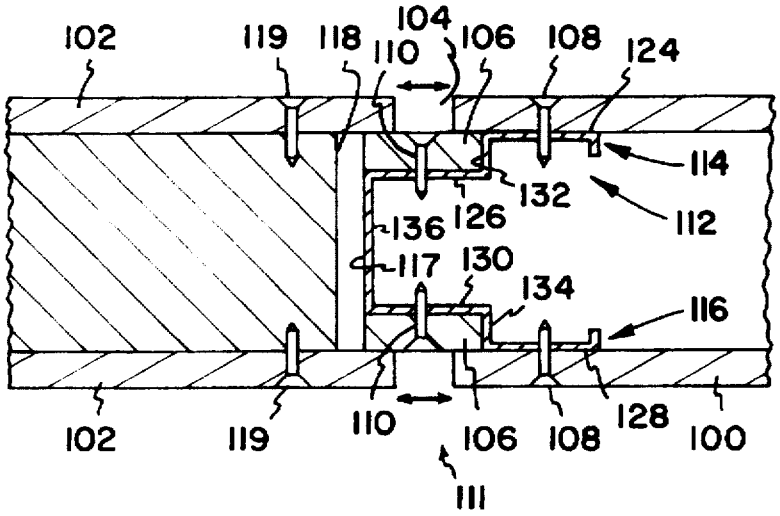
FIG. 8 is a cross-sectional top view of a slidable joint that is vertically positioned within a stud assembly.
Figure 9:
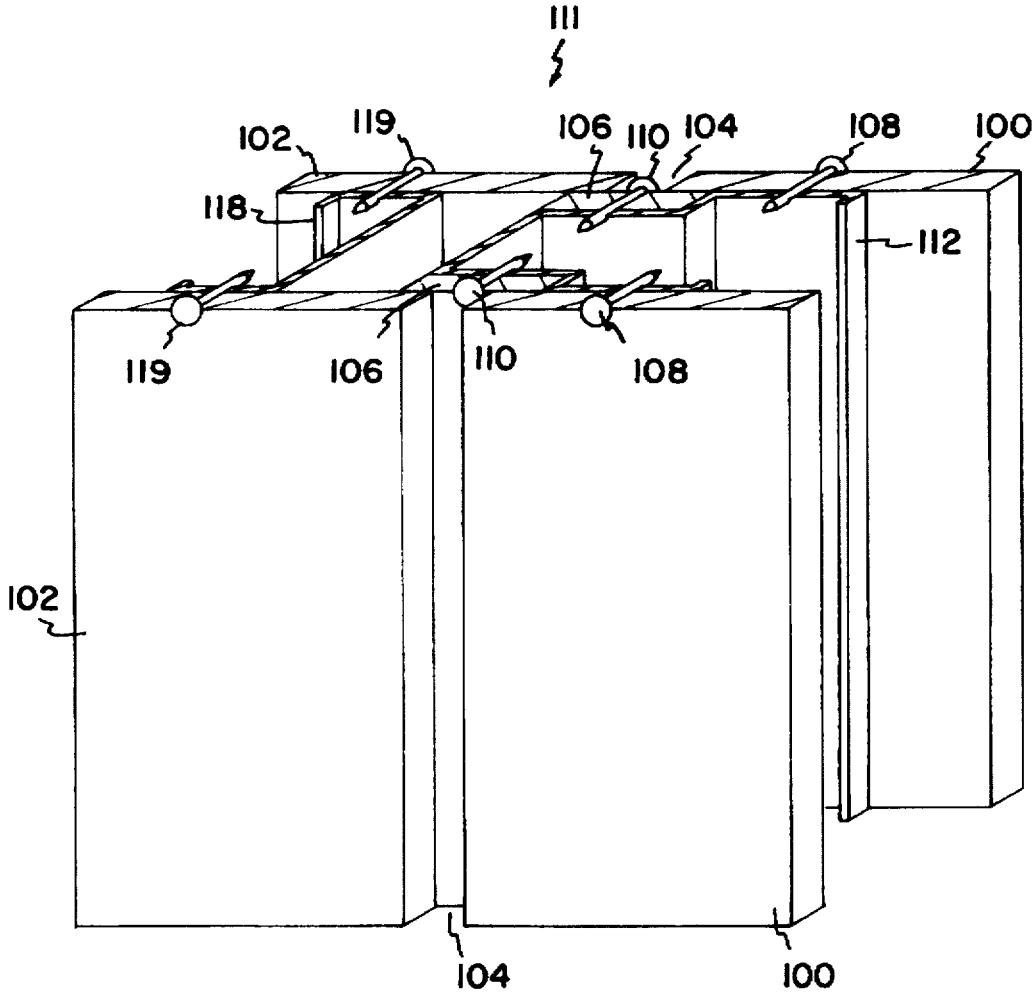
FIG. 9 is a perspective view of the joint of FIG. 8.

FIGS. 8 and 9 show a slidable, substantially vertical connection joint or seam 111. The seam 111 incorporates a slip track 112 having essentially the same configuration as the slip track of FIG. 2. The slip track 112 includes opposing legs 114 and 116 that are connected by an orthogonal member 117 to define an interior channel. The leg 114 of the slip track 112 includes substantially parallel first and second surfaces 124 and 126 that are offset from one another by a generally transverse offset surface 132. The leg 116 includes third and fourth surfaces 128 and 130 that are substantially parallel and are offset from one another by a generally transverse offset surface 134. An orthogonal surface 136 extends transversely between the second and fourth surfaces 126 and 130.

As shown in FIGS. 8 and 9, the slip track 112 is aligned substantially vertically within a conventional stud assembly such as a stud wall. The slip track 112 is mounted between and generally parallel to the studs 118 of the stud wall. The studs are shown as steel studs 118 having a C-shaped cross section. The slip track 112 is used to slidably connect, in a telescopic manner, a first pair of primary wallboard members 100 to a second pair of primary wallboard members 102. It will be appreciated that the primary wallboard members 100 and 102 are connected to the studs 118 of the wall by conventional techniques such as screws 119.

As installed, the slidable track 112 is aligned vertically along gaps 104 between the ends of the first and second pairs of primary wallboard members 100 and 102. Secondary wallboard members 106 are captured between the primary wallboard members 100 and 102 and the second and fourth surfaces 126 and 130 of the track 12. Together with the offset surfaces 132 and 134, the second and fourth surfaces 126 and 130 form shoulders for receiving the secondary wallboards 106. The ends of the primary wallboards 100 and 102 overlap the ends of the secondary wallboard members 106 such that the gaps 104 are closed by the secondary members 106. The first pair of primary wallboards 100 are preferably connected to the track 112 by connectors such as screws 108 that are driven through the first and third surfaces 124 and 128 of the track 112. Similarly, the secondary wallboard members 106 are connected to the track 112 by connectors such as screws 110 that are driven through the second and fourth surfaces 126 and 130 of the track 112.

The second pair of primary wallboards 102 slidably engage the secondary wallboard members 106. In this manner, the first pair of primary wallboards 100 and the second pair of primary wallboards 102 are free to slide with respect to each other. Such movement is typically the result of building movement. When the first pair of primary wallboards 100 and the second pair of primary wallboards 102 move with respect to each other, the gaps 104 either widen or narrow. The overlap between the secondary wallboards 106 and the primary wallboards 100 and 102 functions to maintain a fire resistant seal between the primary wallboards 100 and 102 while providing the primary wallboards 100 and 102 with a limited range of movement relative to each other.

Figure 10:
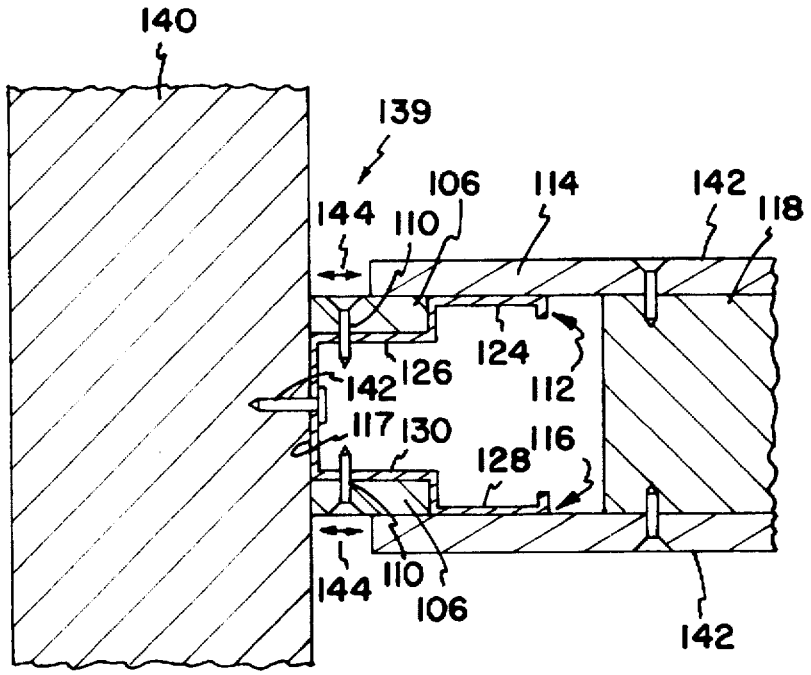
FIG. 10 is a cross-sectional top view of a slidable fire resistant connection between a stud assembly and an intersecting structure.

FIG. 10 shows a slidable, fire-resistant connection joint 139 between a stud assembly, such as a stud wall, and an intersecting structure 140 such as a wall. Similar to the seam of FIGS. 8 and 9, the joint incorporates the slidable track 112. The track 112 is preferably vertically connected to the intersecting structure 140 by conventional connecting techniques, such as screws 142 driven through the orthogonal member 117 of the track 112 and into the intersecting structure 140. As described with respect to FIGS. 8 and 9, secondary wallboard members 106 are affixed to the second and fourth surfaces 126 and 130 of the track 112 by conventional techniques such as screws 110. The stud wall includes primary wallboards 142 having ends that overlap the secondary wallboard members 106 such that the secondary members 106 are captured between the primary wallboards 142 and the second and fourth surfaces 126 and 130 of the track 112. A gap 144 is formed between the end of the primary wallboards 142 and the intersecting structure 140 to provide space for allowing the primary wallboards 142 to move in response to building movement such as settlement. The secondary wallboard members 106 abut against the intersecting structure 140 to provide fire resistant barriers that close the gaps 144. The primary wallboard members 142 slidingly engage the secondary wallboard members 106 such that the secondary wallboard members 106 do not interfere with the movement of the primary wallboards 142.

Figure 11:
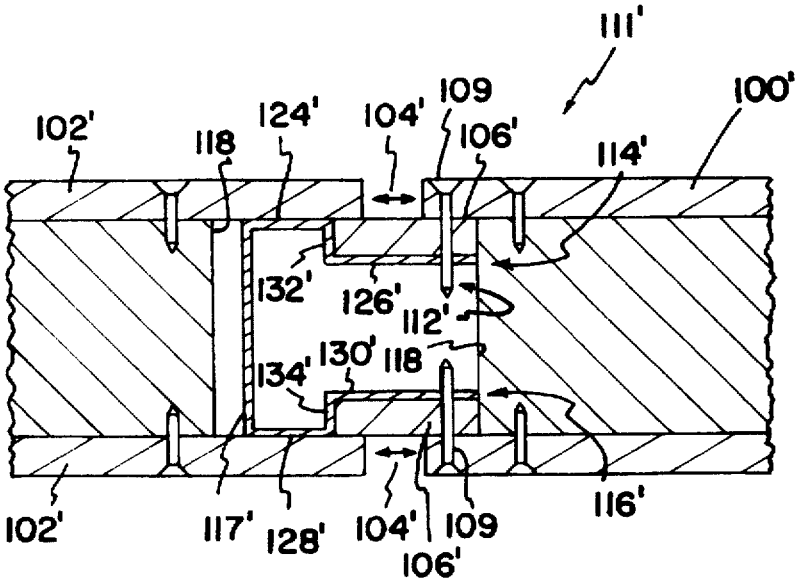
FIG. 11 is a cross-sectional top view of an alternative slidable joint that is vertically positioned in a stud assembly.

FIG. 11 shows a slidable, substantially vertical connection joint or seam 111' that incorporates a slip track 112' having essentially the same configuration as the slip track of FIG. 1. The slip track 112' includes opposing legs 114' and 116' that are connected by an orthogonal member 117' to define an interior channel. The leg 114' of the slip track 112' includes substantially parallel first and second surfaces 124' and 126' that are offset from one another by a generally transverse offset surface 132'. The leg 116' includes third and fourth surfaces 128' and 130' that are substantially parallel and are offset from one another by a generally transverse offset surface 134'.

The connection joint 111' is arranged and configured in a manner similar to the connection joint 111 of FIGS. 8 and 9. The slip track 112' is preferably positioned within a stud wall between first and second pairs of primary wallboard 100' and 102'. The slip track 112' is aligned along gaps 104' defined between the ends of the primary wallboards 100' and 102'. The ends of the primary wallboards 100' and 102' overlap secondary wallboards 106'. The first pair of primary wallboards 100', the secondary wallboards 106' and the second and fourth surfaces 126' and 130' of the track 112' are preferably held rigidly together through the use of screws 109. The second pair of primary wallboards 102' slidably engage the secondary wallboards 106' and the first and third surfaces 124' and 128' of the track 112' such that the first and second pairs of primary wallboards 100' and 102' can move relative to each other. The overlap between the primary wallboards 100' and 102' and the secondary wallboards 106' maintains a fire-resistant barrier as the primary wallboards 100' and 102' move relative to each other.

Figures 12A, 12B:
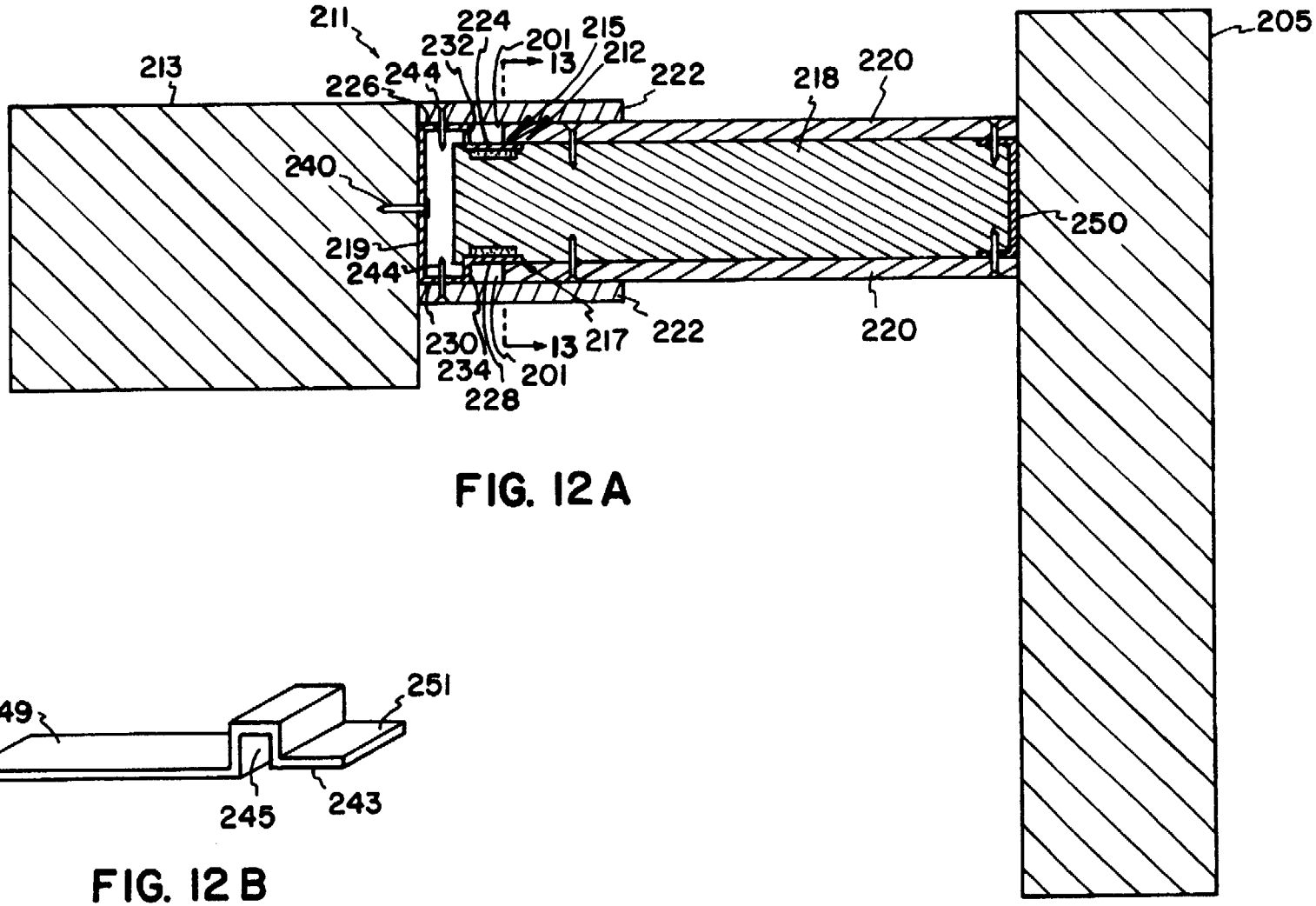
FIG. 12 is a cross-sectional side view of a joint for slidably connecting a stud assembly between a vertical structure such as a wall and a horizontal structure such as a floor assembly.

FIG. 12 shows a slidable, fire-resistant connection joint 211 between a structural element such as a floor structure 213 and a fire-resistant stud barrier assembly. The fire-resistant stud barrier assembly forms a substantially horizontal bridge between the floor structure 213 and the wall 205. The connection joint 211 incorporates a slide track 212 having essentially the same construction as the slide track of FIG. 1. Basically, the slide track 212 includes opposing legs 215 and 217 that are connected by an orthogonal member 219 so as to define a channel for slidably receiving studs 218 of the barrier assembly.

The connection joint 211 has essentially the same construction as the connection of FIG. 1, except the slide track 212 has been rotated and affixed, through conventional means such as screws 240, to a side of a floor structure 213 rather than an overhead structure. The studs 218 preferably have a C-shaped cross section and are aligned horizontally between the floor structure 213 and a wall 205. Primary wallboards 220 are connected to opposite sides of the studs 218.

Figure 13:
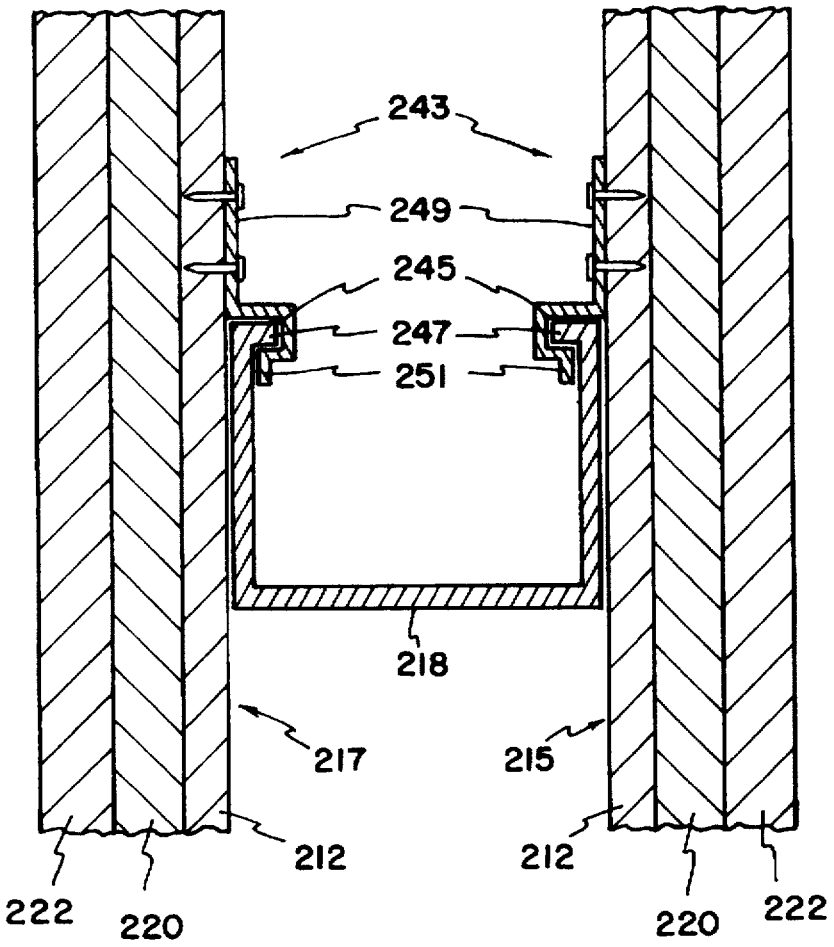
FIG. 13 is a cross-sectional view taken along section line 13—13 of FIG. 12.

One end of each stud 218 is preferably connected to the wall 205 by a conventional U-shaped track 250. The other end of the stud 218 is slidably inserted in the channel defined by the track 212. Clips 243 are used to slidingly connect the stud 218 to the track 212 such the stud 218 is free to slide horizontally but is restrained from moving vertically. As shown in FIG. 13, the clips 243 have notches 245 for receiving, retaining and slidingly engaging the short flanges 247 of the stud 218. First extensions 249 of the clips 243 are affixed, preferably by screws, to the legs 215 and 217 of the track 212. Second extensions 251 of the clips 243 engage the interior of the stud 218.

The leg 215 of the track 212 includes parallel first and second surfaces 224 and 226 that are offset from each other by transverse member 232. Similarly, the leg 217 of the track 212 includes parallel third and fourth surfaces 228 and 230 that are offset from each other by transverse member 234. Secondary wallboard members 222 are connected to the second and fourth surfaces 226 and 230 by conventional connecting techniques such as screws 244. The secondary wallboard members 222 overlap and slidingly engage the primary wallboard members 220 and also abut against the floor structure 213. Gaps 201 exists between the ends of the primary wallboard members 220 and the transverse members 232 and 234 to provide space for the primary wallboards 220 to move horizontally with respect to the secondary wallboards 222. As the secondary wallboards 222 and the primary wallboards 220 slide horizontally with respect to each other, the overlap maintains a fire-resistant barrier.

Figure 14A:
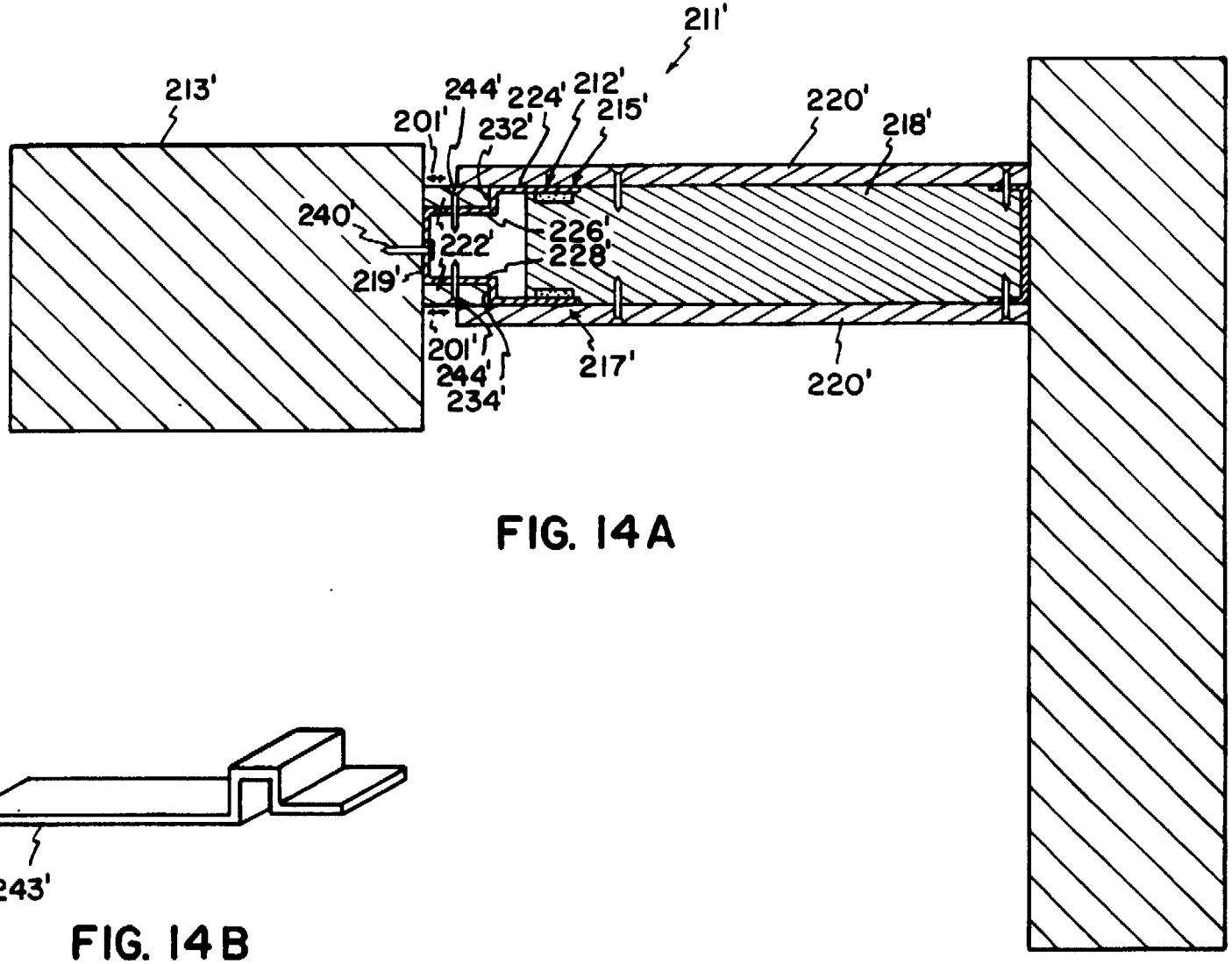
FIG. 14 is a cross-sectional side view of an alternative joint for slidably connecting a stud assembly between a vertical structure such as a wall and a horizontal structure such as a floor assembly.
Figure 14B:
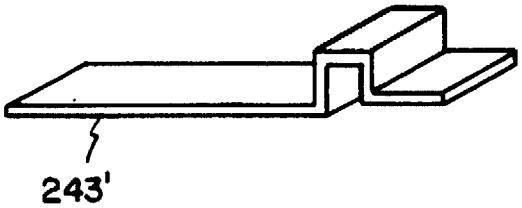

FIG. 14 shows an alternative connection joint 211' slidingly connecting a floor structure 213' to a fire-resistant barrier constructed of studs 218' and primary wallboards 220'. The joint 211' includes a track 212' having a construction essentially the same as the track of FIG. 2. The track 212' is preferably connected to a side of a floor structure 213' by conventional means such as screws 240'. The track 212' includes opposing first and second legs 215' and 217' separated by an orthogonal member 219'. The first leg 215' includes first and second surfaces 224' and 226' that are parallel and offset by transverse surface 232'. The second leg 217' includes third and fourth surfaces 228' and 230' that are parallel and separated by transverse surface 234'.

The track 212' is connected to studs 218' of the barrier by clips 243' as previously described in the specification. Secondary wallboard members 222' abut against the floor structure 213' and are connected to the second and fourth surfaces 226' and 230' of the track 212 by screws 244'. The primary wallboards 220' overlap the secondary wallboards 222' to provide a slidable fire-resistant connection. Gaps 201' exists between the ends of the primary wallboard members 220' and the floor structure 213' to provide space for the primary wallboards 220' to move horizontally with respect to the secondary wallboards 222'.

Figures 15A, 15B:
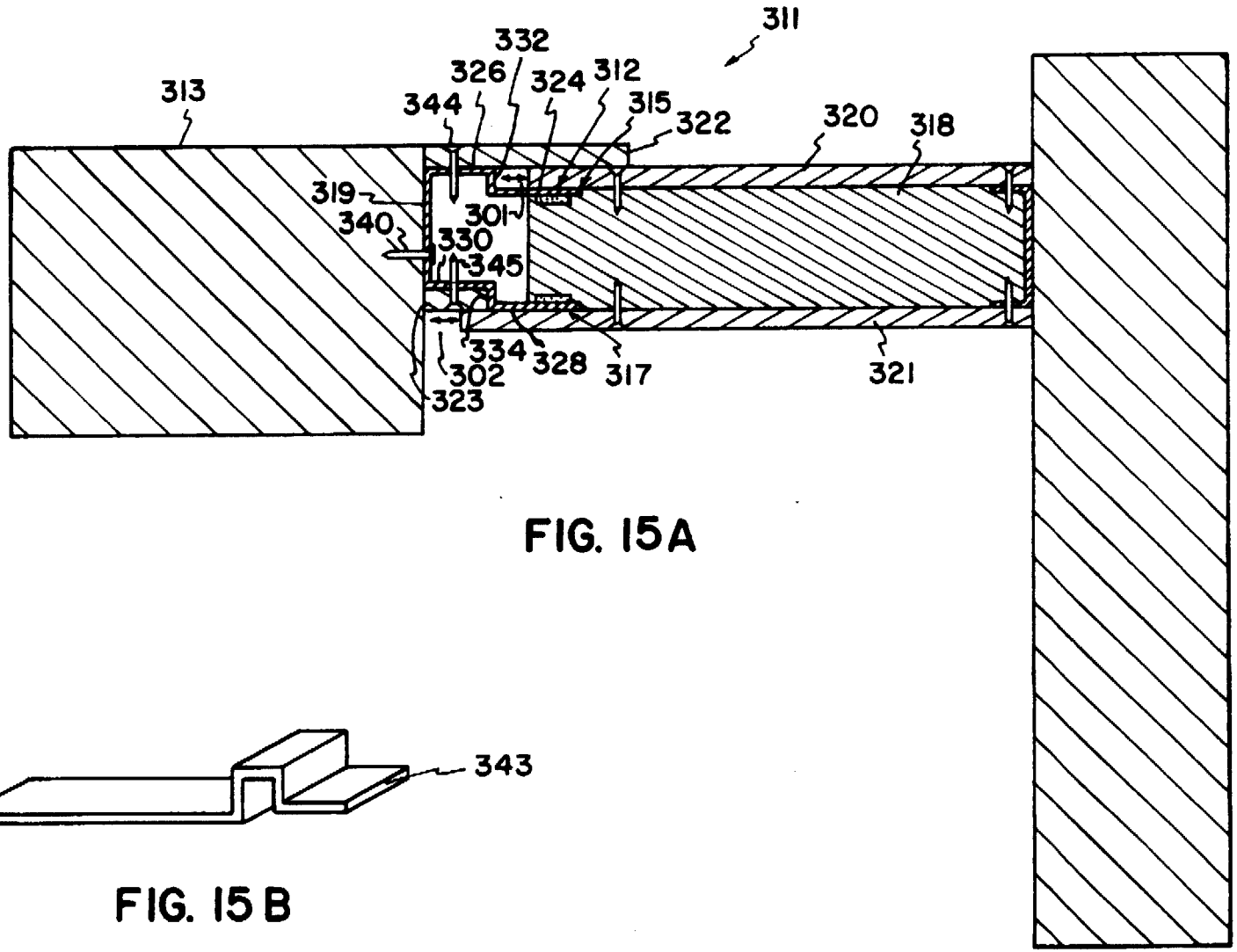
FIG. 15 is a cross-sectional side view of another alternative joint for slidably connecting a stud assembly between a vertical structure such as a wall and a horizontal structure such as a floor assembly.

FIG. 15 shows an alternative connection joint 311 slidingly connecting a floor structure 313 to a fire-resistant barrier constructed of studs 318 and primary wallboards 320 and 321. The joint 311 includes a track 312 preferably connected to the floor structure 313 by conventional means such as screws 340. The track 312 includes opposing first and second legs 315 and 317 separated by an orthogonal member 319. The first leg 315 includes first and second surfaces 324 and 326 that are parallel and offset by transverse surface 332. The second leg 317 includes third and fourth surfaces 328 and 330 that are parallel and separated by transverse surface 334.

The track 312 is connected to studs 318 of the barrier by clips 343 as previously described in the specification. Secondary wallboard member 322 is connected to the second surface 326 of the track 312 by means such as screws 344. Secondary wallboard member 322 abuts against the floor structure 313 and overlaps primary wallboard 320 to provide a slidable fire-resistant barrier. Gap 301 exists between the end of primary wallboard member 320 and transverse surface 332 of the track 312 to provide space for primary wallboard 320 to move horizontally with respect to secondary wallboard 322. Similarly, secondary wallboard member 323 is connected to the fourth surface 330 of the track 312 by means such as screws 345. Secondary wallboard member 323 abuts against the floor structure 313 and is overlapped by primary wallboard member 321 to provide a slidable fire-resistant barrier. Gap 302 exists between primary wallboard member 321 and the floor structure 313 to provide space for primary wallboard 321 to move horizontally with respect to secondary wallboard 323.

The present invention, thus, achieves a fire barrier connection which provides for movement between a stud wall and such structural elements as roofs, interior and exterior walls, and floor structures. The slip track assembly functions in a telescoping fashion. In this way, there is no material which has to be compressed so as to be subject to possible hardening and breaking. The slip track assembly can be constructed with materials which provide for an appropriate fire rating. The assembly then maintains for the lifetime of the materials the fire protection desired.

Thus, numerous characteristics and advantages of the invention have been set forth, together with details of structure and function. It is to be understood, however, that the disclosure is illustrative only. Therefore, any changes made, especially in matters of shape, size, and arrangement, to the full extent extended by the general meaning of the terms in which the appended claims are expressed, are within the principle of the invention.

What is claimed is:

1. A slip track assembly connecting a stud assembly to a structural element, said stud assembly having a plurality of studs with a primary noncombustible member attached thereto, said studs and said primary member being spaced from said structural element, said slip track assembly comprising:

a slip track mechanism having parallel first and second surfaces offset from one another and when used with said studs, said first and second surfaces being located on a common side of said studs, said mechanism including a third surface on a side opposite side said common side, said third surface and one of said first and second surfaces being spaced apart so that said studs can move therebetween, said mechanism further including an orthogonal surface extending between said third surface and one of said first and second surfaces and being arranged for fastening to said structural element;

a noncombustible secondary member; and means for attaching said secondary member to said second surface, said secondary member being slidably engaged with respect to said primary member; and wherein on installation said first and second surfaces of said slip track mechanism and said secondary member relative to said primary member provide a slidable fire barrier connection between said structural element and said stud assembly.

2. The assembly in accordance with claim 1 wherein said slip track mechanism includes first and second members fastened together, said first member providing said first and third surfaces and said second member providing said second surface.

3. The assembly in accordance with claim 1 wherein said slip track mechanism includes first and second members fastened together, said first member providing said first and second surfaces and said second member providing said third surface.

4. A fire-resistant connection joint for use with a stud assembly comprising:

a slip track adapted to be slidably connected to the stud assembly, said slip track including first and second substantially parallel surfaces, the first and second surfaces being offset from each other, said slip track including an orthogonal surface aligned transversely with respect to the second surface, the orthogonal surface being connected to a structural element;

a fire-resistant secondary member affixed to the second surface, the secondary member abutting the structural element; and a fire-resistant first primary member adapted to have a sliding relationship with the secondary member, the first primary member slidably engaging the first surface, and the first primary member and the structural element together defining a gap thereinbetween for providing space for the first primary member to slide relative to the secondary member, the first primary member and secondary member being arranged and configured to overlap one another such that a fire-resistant barrier is maintained when the first primary member and the secondary member slide relative to each other.

* * * * *